US005628555A

United States Patent [19]

Sharrah et al.

[11] Patent Number: 5,628,555

[45] Date of Patent: May 13, 1997

[54] SWITCH ACTUATION MECHANISM FOR A FIREARM-MOUNTED FLASHLIGHT

[75] Inventors: Raymond L. Sharrah, Collegeville; Charles W. Craft, Lansdale, both of Pa.

[73] Assignee: Streamlight, Inc., Norristown, Pa.

[21] Appl. No.: 636,020

[22] Filed: Apr. 22, 1996

[51] Int. Cl.[6] ..... F41G 1/34

[52] U.S. Cl. ..... 362/114

[58] Field of Search ..... 362/110, 113, 362/114; 42/103

[56] References Cited

U.S. PATENT DOCUMENTS

| | | | |
|---|---|---|---|
| 1,088,502 | 2/1914 | Williams | 362/114 |
| 2,140,880 | 12/1938 | Osborn | 362/114 |
| 5,560,703 | 10/1996 | Capps | 362/114 |

OTHER PUBLICATIONS

Surefire Tactical Light & Laser Sight Systems Handbook and Components Selection Guide, Spring 1995, Laser Products.

TACM III Tactically Advanced Combat Mount (Advertising Literature), Diamond Products Marketing, Inc.

*Primary Examiner*—Carroll B. Dority

*Attorney, Agent, or Firm*—Dann, Dorfman, Herrell and Skillman, P.C.

[57] ABSTRACT

A switch actuation apparatus for a firearm-mounted flashlight having a switch mechanism. The apparatus is mounted to a firearm having a grip area for being held by a hand. A support base is adapted to be mounted from the grip area. A slide is movably supported by the support base for causing actuation of the switch mechanism for operating the flashlight. The flashlight is supported by one of the support base or slide. The apparatus further includes an actuating member coupled to the slide for movement relative to the support base. The actuating member has an operating surface accessible to at least a finger of a hand holding the grip area of the firearm for moving the slide to operating the flashlight. In this arrangement, the user of the firearm can easily operate the flashlight without moving a hand from its usual position for holding and operating the firearm.

10 Claims, 3 Drawing Sheets

SWITCH ACTUATION MECHANISM FOR A FIREARM-MOUNTED FLASHLIGHT

FIELD OF THE INVENTION

The present invention relates to a switch actuation mechanism for a firearm-mounted flashlight.

BACKGROUND OF THE INVENTION

People who use firearms in the dark, such as law enforcement officers, must ordinarily use one hand to wield their firearm and use their other hand to wield a flashlight in order to locate and identify their target. If it becomes necessary to shoot, such persons are thus unable to conveniently use a two-handed grip on their weapon, which is preferred for accuracy and for absorbing the recoil energy of the weapon.

Mounting devices are known for mounting a flashlight upon a firearm. One known mounting device for mounting a flashlight to a Glock semi-automatic pistol, comprises a tubular body which attaches to the bottom of an ammunition clip. A flashlight is received within the tubular body and is held in position by a thumbscrew-driven clamp. The preferred flashlight for use in the Glock mounting device is of the type that includes a switch member operable by depressing the rear surface of the flashlight, such as the "SCORPION" flashlight manufactured by Streamlight, Inc. of Norristown, Pa.

Regardless of the type of flashlight employed in such a mount, it is necessary for the user to alter his grip upon the weapon in order to operate the flashlight, particularly when using a rifle. While the user could initially turn the flashlight on, and subsequently leave the flashlight on, such operation would be hazardous if the user did not want his location to be known at all times. It would thus be desirable to provide a switch actuation mechanism for a firearm-mounted flashlight that would allow the user to operate the flashlight without having to substantially alter his grip from a normal firing grip on the weapon.

SUMMARY OF THE INVENTION

In accordance with the present invention, a switch actuation mechanism for a firearm-mounted flashlight is provided wherein a support base adopted to be mounted from the grip area of the firearm. A slide is provided which is movably supported by the support base for causing actuation of a switch mechanism of a flashlight. The flashlight is supported by one of the support base or slide. The slide includes an actuating member coupled thereto for movement relative to the support base. The actuating member has an operating surface accessible to at least a finger of a hand holding the grip area for moving the slide to operate the flashlight. In the preferred embodiment, the flashlight switch is a momentary switch having sufficient resiliency for being maintained in an "of" position, such that depressing the operating surface of the actuating member will turn the flashlight on, and releasing the lever will allow the flashlight to turn off. In this arrangement, the flashlight is operable by a finger of the hand holding the grip area of the firearm.

BRIEF DESCRIPTION OF THE DRAWINGS

The foregoing summary, as well as the following detailed description of the preferred embodiments of the present invention, will be better understood when read in conjunction with the appended drawings, in which.

DETAILED DESCRIPTION OF THE PREFERRED EMBODIMENTS

Figure 1:
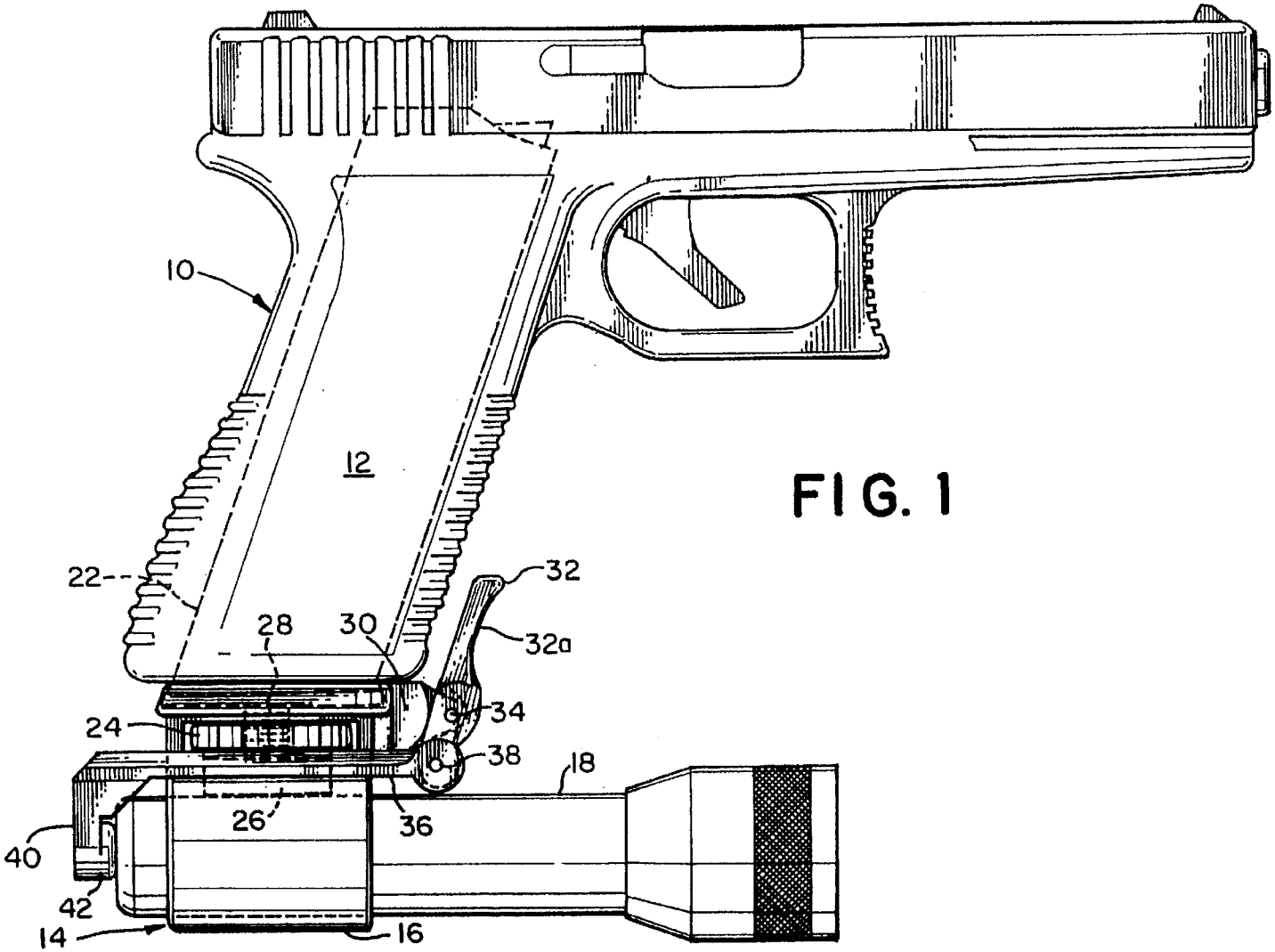
FIG. 1 is a side elevational view of a pistol equipped with the apparatus of the present invention and showing the apparatus holding a flashlight in position for having its switch mechanism activated.
Figure 2:
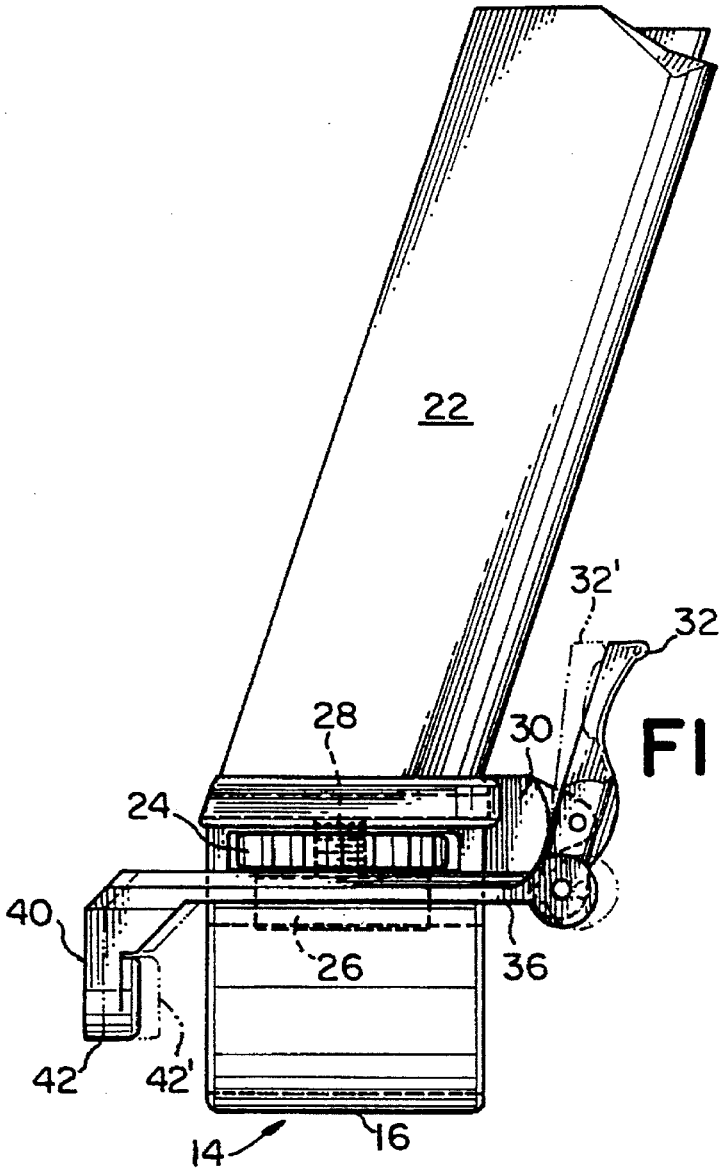
FIG. 2 is a side elevational view of an ammunition clip for the pistol of FIG. 1 and showing the apparatus of the invention with the flashlight removed.
Figure 3:
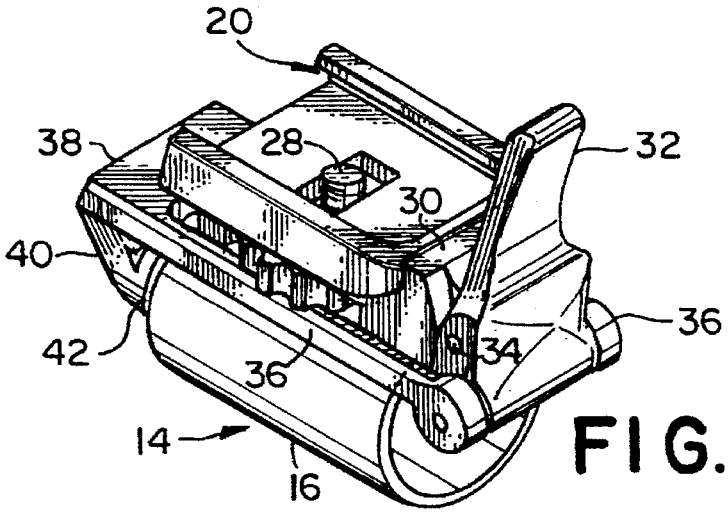
FIG. 3 is a perspective view of the apparatus for mounting a flashlight of FIG. 2 but with the ammunition clip of FIG. 2 and the support base on the ammunition clip omitted.

Referring now to FIG. 1, there is shown a pistol generally designated 10. The pistol 10 has a handle 12 to which a flashlight carrier generally designated 14 is attached. The carrier 14 provides a support base mounted to the grip area or handle of the pistol and includes a tubular portion 16 for receiving the body of a tubular flashlight 18 therein. The carrier or support base 14 further includes attachment means for attaching the carrier 14 to the pistol 10 so that the tubular portion 16 is suspended below the handle 12 of the pistol 10. As best shown in FIG. 3, the carrier 14 has a retaining rim 20 formed along an upper surface thereof. The retaining rim is formed for receiving and retaining an outwardly extending flange (indicated in dotted lines) on opposite sides of the bottom of an ammunition clip 22, as shown in FIG. 2. The flanges on the bottom of the ammunition clip fit within the retaining rim 20 to hold the parts together.

A thumbwheel 24 is positioned within the mid section of the carrier 14 between the tubular portion 16 and the retaining rim 20. A threaded rod 28 is captured within the thumbwheel 24. A clamping block 26 (shown in dotted lines in FIGS. 1 and 2) is attached to the lower end of the rod 28 so that, as the thumbwheel is rotated, the clamping block 26 is driven up or down within the body 16 of the carrier 14 in order to releasably clamp the flashlight 18 within the tubular portion 16. The carrier 14 may be of the type manufactured by Glock of Austria for use with a Glock semi-automatic pistol. The flashlight 18 may be of the type manufactured by Streamlight, Inc. of Norristown, Pa., under the trademark "SCORPION", which is a small, high intensity flashlight.

A fulcrum member 30 is attached to the forward surface of the carrier 14. The fulcrum member 30 can be attached to the carrier 14 by screws (not shown), by a suitable adhesive, or may be formed as a unitary body with the carrier 14. An actuating member or lever 32 is pivotally supported on the fulcrum member 30 about pin 34 extending through the lever 32 and the fulcrum member 30. The lever 32 is thus mounted upon the fulcrum member 30 to pivot between the respective alternative orientations as indicated at 32 and 32' in FIG. 2. The lever 32 is positioned upon the carrier 14 such that the forward surface **32*a* of the lever is aligned with the forward surface of the handle 12 of the pistol 10 and provides an operating surface for moving the level with a finger of the hand on the pistol grip area. More specifically, forward surface 32*a* of the lever 32 is aligned with the lower portion of the handle 12** so that the user may grasp the pistol 10 in substantially a normal firing position with the lowermost finger of his dominant hand resting against the forward or operating surface 32*a* of the actuating member or lever 32.

A slide or link member 36 is pivotally coupled to the lower end of the lever 32 at pivot pin 38 extending through the link member 36 and the lever 32. The pivotal connection between link member 36 and lever 32 provides linear translation of the slide 36 in the forward direction when lever 32 is depressed to pivot upon pin 34. In the preferred embodiment, a pair of slides 36 are positioned along opposite sides of the mid-section of the carrier 14. More specifically, the slides or link members are arranged to slide beneath the lower surfaces of the thumbwheel 24 and above the upper surfaces of the tubular body 16. The link members 36 are preferably joined together at the rear ends thereof forming a yoke 38. As an alternative arrangement, a single link member may be employed and extend through the interior of an appropriately-modified carrier 14, so that there are no moving parts positioned along the opposite sides of carrier, if desired.

An arm or support member 40 is rigidly connected to the rear of the link member 36 at the yoke 38. The support member 40 is suspended from the yoke for supporting a protrusion or boss 42 in substantial alignment with the central axis of the tubular portion 16 of the carrier 14. When the flashlight 18 is positioned within the carrier 14, the boss 42 is thus positioned against the rear of the flashlight, so that actuation of the lever 32 causes the boss 42 to be urged into the position designated 42' (shown in FIG. 2) in order to depress a switch mechanism, known as a tail cap switch (not shown), positioned at the rear end of the flashlight.

The switch mechanism of the flashlight 18 preferably comprises a momentary switch of the type that turns the flashlight "on" when depressed, and which turns the flashlight "off" when released. The switch mechanism further provides sufficient resilience to urge against the boss 42 in order to return the lever 32 to the forward position when the lever is released by the finger of the user's hand from the depressed position 32'.

As can be appreciated, by positioning the operating surface 32*a* in alignment with the lower portion of the handle 12, and within reach of the user's lowermost finger, the flashlight 18 can thus be operated while substantially maintaining a normal firing grip on the pistol 10. Additionally, the user may operate the flashlight while maintaining a two-handed grip on the pistol for improved aiming accuracy and recoil resistance.

Several alternative embodiments are contemplated within the scope of the invention. For example, the forward end of link member 36 can be connected to the lever 32 on the same side of the fulcrum as the operating surface 32*a*, as long as a lever mechanism (not shown) is provided at the rear end of the link member for driving the boss 42 in the opposite direction when the lever 32 is pulled toward the handle. Alternatively, the operating surface 32*a* of the lever 32 may be positioned to face the handle 12, so that the flashlight 18 can be operated by the user extending his lower finger away from the handle 12, rather than by pulling the lever 32 toward the handle 12 as has been described.

Figure 4:
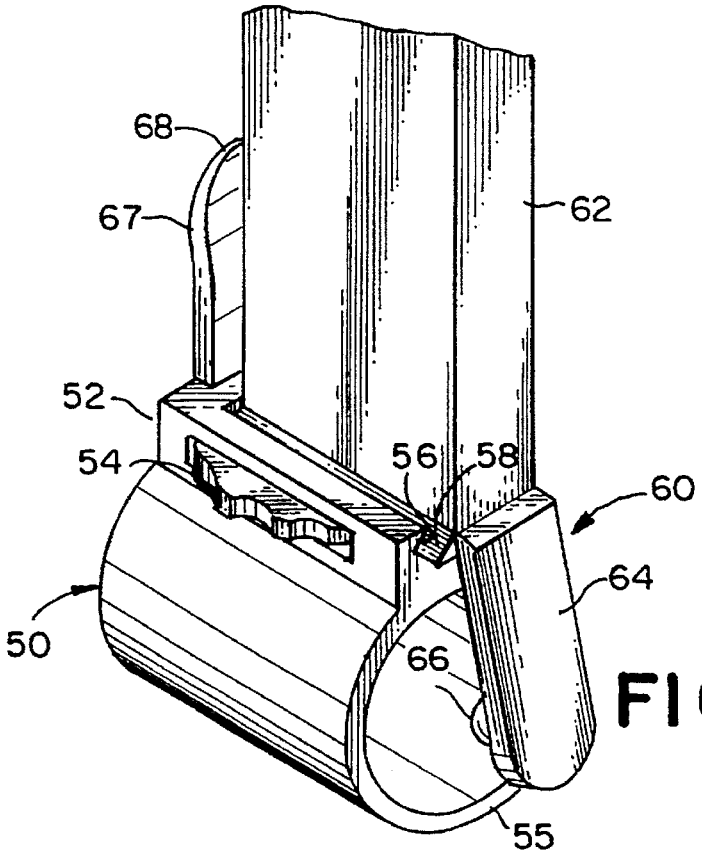
FIG. 4 is a perspective view of an alternative embodiment of an apparatus for holding a flashlight to the ammunition clip of a firearm.

As can be appreciated, a general principle of the invention is to provide a switch actuation mechanism that is readily accessible to the user while maintaining a normal firing grip on the firearm. It is also desirable to provide a simple, easily operated mechanical linkage for the actuation surface to effect relative movement between a releasably-held flashlight and the switch driving member. Such relative movement may be effected by maintaining the flashlight in a fixed position while urging a switch driving member against the switch mechanism of the flashlight, as described above, or by urging the flashlight against a switch driving member. Such an alternative arrangement is shown in FIG. 4.

A carrier generally designated 50 is provided for receiving the barrel of a flashlight (not shown). The carrier 50 includes a thumbwheel housing 52, in which a thumbwheel 54 is disposed for operating a clamp (not shown) for releasably holding the flashlight within the flashlight receptacle portion 55 of carrier 50. The top portion of the carrier 50 has a groove 56 formed therein for providing a receptacle receiving a mating surface of an attachment fixture or support base 60. The attachment fixture or support base 60 is formed on the bottom of an ammunition clip 62. 0f course, the support base may be attached to another suitable part of a firearm such as the handle.

The carrier or slide 50 is held in sliding engagement with the support base 60. The fixture or support base 60 further includes an arm or actuating member 64 suspended from the rear of the support base 60 for supporting a protrusion or boss 66 in alignment with the central axis of the tubular portion of the carrier 50, so that the boss 66 is positioned to abut against the tail switch of the flashlight (not shown) during use of the actuation mechanism. An operating surface 67 is provided on the forward surface of a trigger or actuating member 68 connected to the forward end of the carrier 50.

When the flashlight is installed in the carrier or slide 50, the switch actuation mechanism is operated by depressing the operating surface 67 of the actuating member 68. Depressing the trigger member 68 will cause the slide 50 to move or slide rearwardly upon the support base 60, so that the tail cap switch mechanism of the flashlight will be urged against the boss or stop 66 to turn on the flashlight. As noted above, in the preferred embodiment of the invention, the flashlight includes a momentary switch mechanism having sufficient resiliency to bias the flashlight away from the boss 66 when the trigger 68 is released, thus turning the flashlight off.

Figure 7:
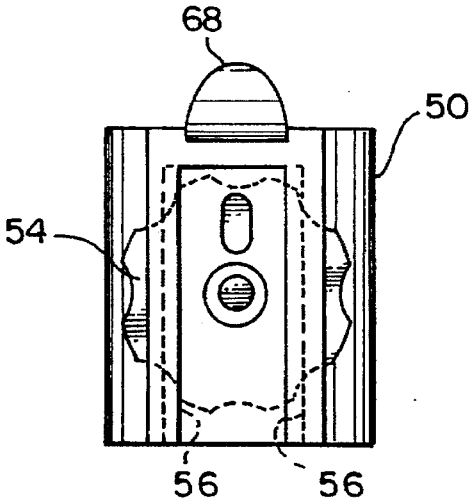
FIG. 7 is a top plan view of the flashlight holding slide of FIG. 4.
Figure 5:
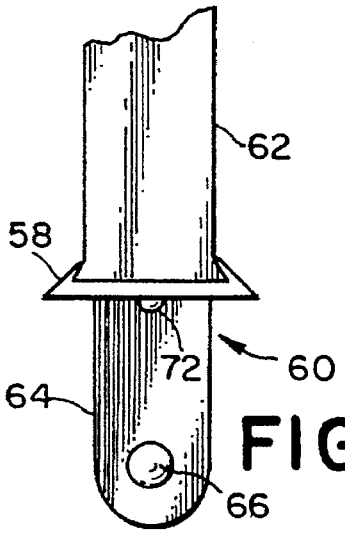
FIG. 5 is a front elevational view of the ammunition clip with the support base and switch actuation of FIG. 4.
Figure 6:
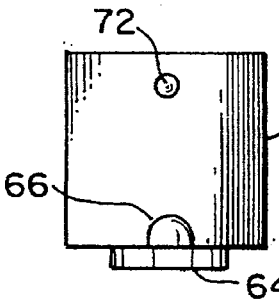
FIG. 6 is a bottom plan view of the structure of FIG. 5.

Referring now to FIG. 5, there is shown the attachment support base or fixture 60 in position on the bottom of the ammunition clip 62 and with the slide or carrier 50 removed. The bottom surface of the fixture has a detent 72 formed thereon for retaining the carrier 50 in slidable engagement with the fixture, and for preventing the carrier 50 from being inadvertently removed from the fixture during normal operation. As can be seen in FIG. 6, the detent 72 may be a ball-type detent member formed on the bottom surface of the fixture 60. Referring to FIG. 7, a mating groove or recess 70 is formed in the upper surface of the carrier 50 for receiving the detent 72 and for allowing the carrier 50 to slide upon the fixture 60 within limits established by the length of the groove 70.

The switch actuation mechanism for a firearm-mounted flashlight has been described with respect to a pistol. It will be appreciated by those skilled in the art that the mechanism of the invention can easily be applied to a rifle and support the flashlight below one of the grip areas of a rifle. The mechanism could be supported by or on the trigger guard or on a post attached to the rifle and extending downwardly from the lower surface of the rifle where a hand would normally grip the rifle in use.

It should also be appreciated that with the use of the present invention, the flashlight can be clamped into and removed from the carrier, which provides greater versatility for use of the flashlight. Furthermore, by clamping the flashlight into the carrier by merely operating the thumbscrew, the flashlight can be easily and quickly inserted into and removed from the carrier on the firearm.

The terms and expressions which have been employed are used as terms of description and not of limitation. There is no intention in the use of such terms and expressions of excluding any equivalents of the features shown and described or portions thereof. It is recognized, however, that various modifications are possible within the scope and spirit of the present invention as claimed.

What is claimed is:

1. An apparatus for operating a switch mechanism on a flashlight, the apparatus being mounted to a firearm having a grip area for being held by a hand, the apparatus comprising:

a support base adapted to be mounted from the grip area;

a slide movably supported by the support base for causing actuation of the switch mechanism of the flashlight for operating the flashlight; the flashlight being supported by one of the support base or slide; and an actuating member coupled to the slide for movement relative to the support base and having an operating surface accessible to at least a finger of a hand holding the grip area for moving the slide to operate the flashlight, whereby the flashlight is operable by a hand holding the grip area of the firearm.

2. The apparatus of claim 1 wherein the firearm is a pistol, and the support base is aligned with a lower portion of the handle.

3. The apparatus of claim 2 wherein the switch mechanism of the flashlight comprises a momentary switch for turning the flashlight on when the actuating member is actuated, and for allowing the flashlight to turn off when the actuating member is released.

4. The apparatus of claim 2 in which the actuating member is pivotally coupled to the support base and wherein the slide is coupled to the actuating member for movement in operating the switch mechanism.

5. The apparatus of claim 4 wherein the switch mechanism is located at the rear of the flashlight, the slide includes an arm having a boss, the arm supporting the boss in alignment with the switch mechanism.

6. The apparatus of claim 5 wherein the switch mechanism comprises a momentary switch for turning the flashlight on when the actuating member is operated, and for allowing the flashlight to turn off when the actuating member is released.

7. The apparatus of claim 1 wherein the switch mechanism comprises a momentary switch for turning the flashlight on when the actuating member is operated and for allowing the flashlight to turn off when the actuating member is released.

8. An apparatus, comprising:

a support base attached to a grip area of a firearm;

including a flashlight holder the support base and adapted to receive a flashlight with a switch mechanism;

a slide movably supported by the support base for causing actuation of the switch of the flashlight;

an actuating member coupled to the slide for moving the slide to actuate the switch, the actuating member having an operating surface accessible to at least a finger of a hand holding the grip area, whereby the flashlight is operated by a hand holding the grip area.

9. The apparatus of claim 8 wherein the support base is mounted to an ammunition clip positionable within the handle of the firearm.

10. The apparatus of claim 8 wherein the support base is configured to support the flashlight below the handle of the firearm, the holder comprises a tubular portion for receiving the flashlight therein, the slide includes a switch driving member substantially in axial alignment with the tubular portion of the holder for actuating a tail switch of the flashlight.

* * * * *